United States Patent [19]

Stroucken

[11] Patent Number: 4,915,682

[45] Date of Patent: Apr. 10, 1990

[54] CENTRIFUGAL SEPARATOR

[75] Inventor: Klaus Stroucken, Rönninge, Sweden

[73] Assignee: Alfa-Laval Separation AB, Tumba, Sweden

[21] Appl. No.: 249,498

[22] Filed: Sep. 27, 1988

[30] Foreign Application Priority Data

Oct. 13, 1987 [SE] Sweden ..... 8703966

[51] Int. Cl.[4] ..... B04B 1/08

[52] U.S. Cl. ..... 494/70; 494/56; 494/64; 494/67; 494/76

[58] Field of Search ..... 494/40, 64, 67, 76, 494/77, 38, 68–73, 56

[56] References Cited

U.S. PATENT DOCUMENTS

| | | | |
|---|---|---|---|
| 1,303,203 | 5/1919 | Hughes et al. | 494/56 X |
| 1,887,476 | 11/1932 | Lindgren | 494/70 X |
| 2,087,630 | 7/1937 | Schelbeck | 494/64 |
| 4,698,053 | 10/1987 | Stroucken | 494/70 |

FOREIGN PATENT DOCUMENTS

| | | | |
|---|---|---|---|
| 115438 | 11/1900 | Fed. Rep. of Germany | 494/71 |
| 342445 | 10/1921 | Fed. Rep. of Germany | 494/67 |
| 440515 | 7/1912 | France | 494/64 |
| 19666 | 7/1905 | Sweden | 494/70 |
| 434263 | 8/1935 | United Kingdom | 494/67 |
| 580384 | 9/1946 | United Kingdom | 494/64 |

*Primary Examiner*—Harvey C. Hornsby
*Assistant Examiner*—Stephen F. Gerrity
*Attorney, Agent, or Firm*—Davis Hoxie Faithfull & Hapgood

[57] ABSTRACT

A liquid separator has a centrifuge rotor (1) with a set of conical separation discs (21) arranged coaxially in the separation chamber (13). The inlet of the separation chamber is formed as inlet passages (20) which extend radially outwards from a central inlet chamber (16) in the rotor, along that end wall of the separation chamber, towards which the apex ends of the separation discs face. The inlet passages (20) are formed between that end wall and a partition member (18, 19) situated between the rotor end wall and the separation discs (21). The outlet of the separation chamber (13) for separated liquid is formed by a number of channels (22) through the partition member (18, 19) and aligned channels through tubular members (23) bridging said inlet passages (20). The channels through the tubular members (23) thus cross the inlet passages (20) and communicate with the channels (24) in the above said rotor end wall, which channels (24) also constitute parts of the outlet from the separation chamber (13) for separated liquid.

10 Claims, 2 Drawing Sheets

CENTRIFUGAL SEPARATOR

FIELD OF THE INVENTION

The present invention relates to a centrifugal separator for the separation of two components from a liquid mixture thereof. The centrifugal separator comprises a rotor body forming a central inlet chamber and a separation chamber, which latter has an inlet for a liquid mixture and at least one outlet for a separated liquid component thereof, a set of conical separation discs which are arranged in the separation chamber coaxially with the rotor body such that their base portions face towards one end and their apex portions towards the other end of the separation chamber, and a partition member arranged between the separation discs and a part of the rotor body such that it delimits inlet passages connecting the central inlet chamber with the separation chamber at the end of the latter, towards which the apex portions of the separation discs face.

BACKGROUND OF THE INVENTION

A centrifugal separator of the kind described is shown for instance in the Swedish Patent No. 19 666 from 1904. It is unknown whether a centrifugal separator of this kind has been produced and used. From the turn of the century and thereafter the inlet of the separation chamber in centrifugal separators of this kind has been situated at the end of the separation chamber, towards which the base portions of the separation discs face. A conventional centrifugal separator of this kind is shown for instance in U.S. Pat. No. 3.986.663.

A principle advantage of a centrifugal separator, in which a mixture is conducted into the separation chamber at the end, toward which the apex portion of the separation discs face, is that the result of a pre-separation taking place in said inlet passages before the mixture has entered the separation chamber, can be taken maximum advantage of. Thus, a part of a relatively heavy component of the mixture, for instance solids, may be separated even as the mixture is on its way through said inlet passages extending between the central inlet chamber and the inlet of the separation chamber.

Relatively heavy components of the supplied mixture, separated in the inlet passages, may slide along the outer walls of the inlet passages directly into the outermost part of the separation chamber, radially outside the separation discs, without being disturbed by or disturbing the rest of the mixture when this flows into the separation chamber.

In a conventional centrifugal separator, in which the liquid mixture is instead introduced through inlet passages at the end of the base portion of the separation chamber, towards which the base portions of the separation discs face (see for instance U.S. Pat. No. 3.986.663), a relatively heavy component of the mixture, separated in the inlet passages, is forced to cross the flow of the rest of the mixture where the latter enters the separation chamber. This is a consequence of the fact that the inlet passages have an inclination relative to the rotor axis just about that of the conical separation discs. Thereby the result of the pre-separation in the inlet passages is spoiled wholly or partly. This undesired effect of the cross flow will become greatest when the mixture in its entirety is introduced into the separation chamber at the outer edge of the separation disc situated closest to the inlet passages.

A possible reason why the design known already in 1904 has not been generally accepted may have been practical difficulties with the sealing within the centrifuge rotor between the crossing flows of liquid mixture on the way into and separated liquid component on the way out of the separation chamber. In the known design the previously mentioned partition member is axially movable relative to a central column in the rotor body, against which it should seal radially at its inner edge during operation of the rotor. The inner edge of the partition member and, thus, the sealing place are situated very close to the outlet of the separation chamber for separated liquid component. Since the partition member has to be separated from the column each time the centrifuge rotor is disassembled for removal of separated sludge from the separation chamber, difficulties may arise with the sealing between the column and the partition member. Leakage of inflowing mixture to outflowing separated liquid will of course destroy the separation result.

BRIEF DESCRIPTION OF THE INVENTION

The object of the present invention is to provide a centrifugal separator based on the principle of the prior patent specification referred to for the introduction of the mixture into the rotor but which is designed to provide a simple and practically usable solution for the sealing problem.

According to the invention this object can be achieved in a centrifugal separator of the initially defined kind in a way such that, the partition member has a number of through holes and said part of the rotor body corresponding through holes, and that tubular members are connected with the partition member as well as the rotor body around the respective through holes, so that closed outlet channels are formed from the separation chamber, the direction of which crosses the direction of the inlet passages between the inlet chamber and the inlet of the separation chamber.

If a centrifuge rotor designed in this way comprises a central column of the previously mentioned kind and sealing means between this and the partition member, substantially less demands may be put on such sealing means than on the corresponding sealing means in the known design of 1904. This follows from the fact that in the invention the outlet of the separation chamber for separated liquid component does not have to be situated in the vicinity of the inner edge of the partition member but may be placed at a safe distance therefrom radially as well as axially. Preferably, the partition member has a central, sleeve-formed part situated radially inside the separation discs and extending axially past several of them, so that said sealing place can be arranged at a large distance from the outlet of the separation chamber. If in a design of this kind a small leakage of mixture were to come up through the sealing place, such leaking mixture would have time to be subjected to sufficient centrifuging to be freed from particles suspended therein, before it the outlet of the separation chamber.

however, the invention is not restricted to a centrifuge rotor in which the partition member seals radially against a central column. Since the inlet chamber of the rotor may be situated on one side and the separation chamber on the other side of the partition member, the latter need not have a central opening admitting throughflow of mixture on its way into the separation chamber. A design of this kind is suitable if the rotor body comprises two main parts kept axially together at the periphery of the rotor body.

Regardless of whether two main parts of the rotor body are connected with each other at the periphery or through a central column the partition member preferably is firmly connected with the above mentioned portion of the rotor body by means of the tubular members, so that it can be removed together with one main part of the rotor body when this is separated from the other part in connection with disassembling of the rotor body; for instance, in connection with cleaning.

In a preferred embodiment of the invention the tubular members are formed in one piece with either the partition member of the rotor body. Preferably at least one of the partition member and the rotor body is made of plastic, so that a tight, so-called snap lock connection can easily be established between these rotor parts around each of the tubular members.

The design suggested according to the present invention makes it possible for produce a small centrifugal separator to a very low price.

DESCRIPTION OF THE DRAWINGS

The invention is described in more detail below with reference to the accompanying drawings in which.

DETAILED DESCRIPTION OF THE INVENTION

Figure 1:
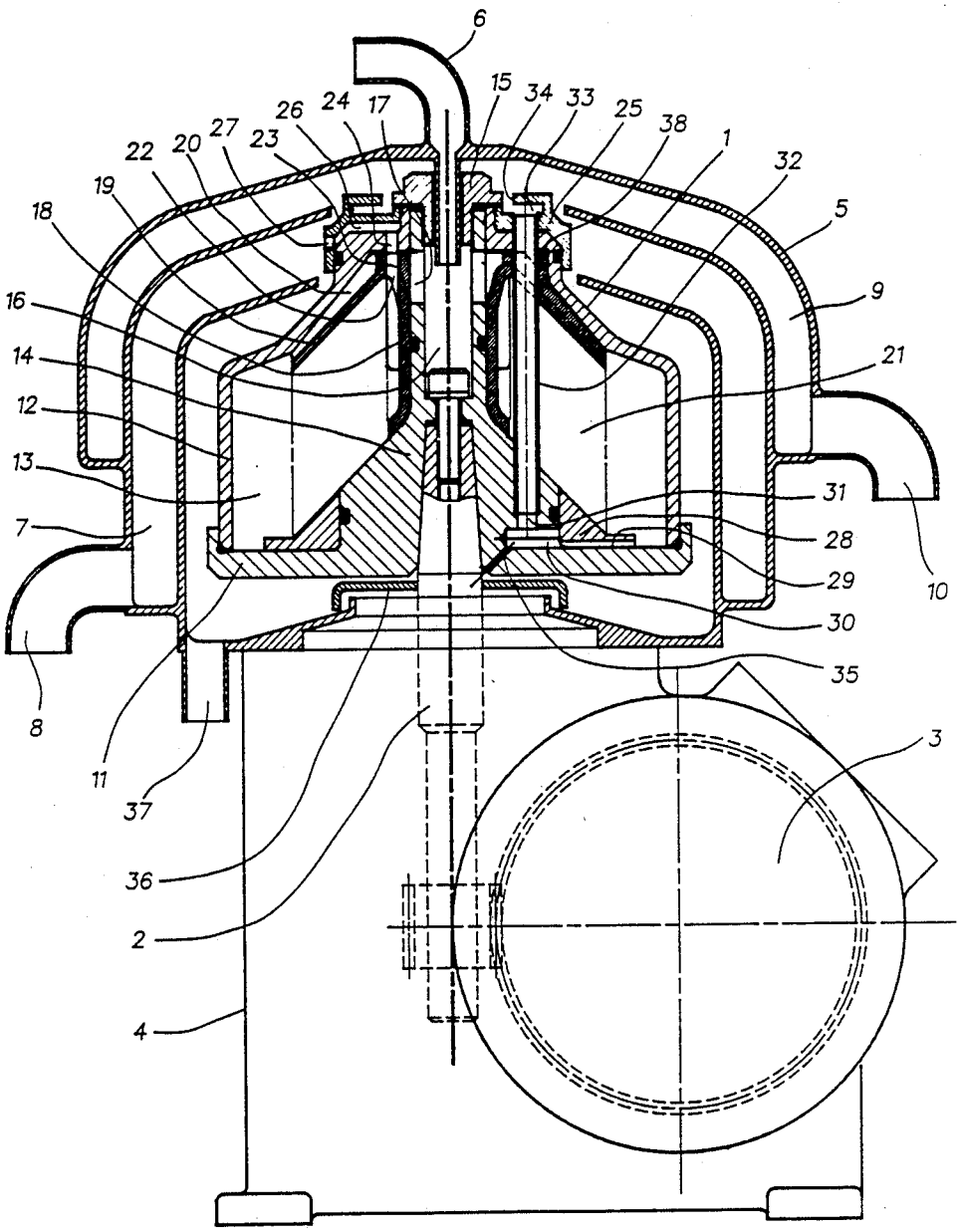
FIG. 1 shows a centrifugal separator according to a preferred embodiment of the invention.

Referring to FIG. 1, this shows a centrifugal separator having a rotor 1, a vertical drive shaft 2 supporting the rotor, a driving device 3 in engagement with the drive shaft, a lower housing 4 for the driving device 3 and an upper housing 5 for the rotor.

The upper housing 5 forms an inlet tube 6 for a mixture of two liquids having different densities and having particles suspended therein. Further, the housing 5 forms a receiving chamber 7 having an outlet 8 for a separated relatively light liquid and a receiving chamber 9 having an outlet 10 for a separated relatively heavy liquid.

The rotor 1 comprises two rotor parts 11 and 12, which are kept axially pressed against each other and which surround a separation chamber 13. The rotor part 11, which forms the bottom of the separation chamber 13 and is connected with the drive shaft 2, has a central column 14 the upper part of which arrests the rotor part 12 by means of an annular locking member 15. The rotor part 12 forms a substantially cylindrical surrounding wall and a substantially conical upper end wall of the rotor.

A narrow end portion of the inlet tube 6 extends axially through the locking member 15 into a central inlet chamber 16 formed in a tubular upper portion of the central column 14. This tubular portion of the column 14 has several openings 17 in its surrounding wall. The locking member 15 forms an upper annular end wall in the inlet chamber 16.

Around the central chamber 14 there is arranged a partition member having a sleeve formed part 18 and a conical part 19. The sleeve formed part 18 surrounds the column 14 below said openings 17. An annular gasket seals between the sleeve formed part 18 and the column 14. The conical part 19 abuts against said upper end wall of the rotor. Radial recesses in the conical part 19 form between this and the rotor end wall several passages 20 which connect the openings 17 with the separation chamber 13.

A set of frusto-conical separation discs 21 is arranged between the conical part 19 and the lower rotor part 11 in the separation chamber 13, coaxially with the rotor axis. The conical part 19 of the partition member has about the same cone angle as these separation discs. The outer edges of the separation discs 21 are situated substantially at the same radial level as the outer edge of the conical part 19. The inner edges of the separation discs 21 are situated at some radial distance outside of the sleeve formed part 18, so that a central space is formed in the separation chamber 13 radially inside the separation discs 21. This space is divided in parallel axial channels by radially and axially extending wings supported by the sleeve formed part 18.

The conical part 19 has a number of, e.g. three, axially through channels 22 and supports on its upper side an equal number of tubular members 23, the interior of which communicates with the channels 22. The rotor part 12 has an equal number of axially through channels 24 which are situated such that they communicate through the tubular members 23 with the respective channels 22. An annular gasket is arranged to seal between the tubular members 23 and the rotor part 12 around the channels communicating with each other.

Upon the rotor part 12 there is arranged an annular member 25, which together with the rotor part 12 forms a chamber 26, into which the channels 24, through the rotor part 12. The chamber 26 has one or several peripheral outlets 27.

In the lower part of the separation chamber 13 there is placed an annular member 28 which seals radially inwards and axially downwards against the rotor part 11 and which extends radially outwards in the separation chamber 13 a distance longer than the separation discs 21. On its under side the annular member 28 has a number of radial grooves, which form channels 29 extending between the separation chamber 13 and an equal number of central radial channels 30 in the rotor part 11. The radial channels 30 communicate with a number of axial channels 31, in which axial tubes 32 are inserted.

The tubes 32 extend through aligned holes in the separation discs 21 and further through holes in the previously mentioned conical part 19, holes in the rotor part 12 and holes in the annular member 25. Sealing gaskets are arranged around said holes and around the tubes 32 between the rotor part 12 and both the conical part 19 and the annular member 25.

The interior of the tubes 32, that communicates through the channels 29–31 with the separation chamber 13, opens into a radially inwards open groove 33 in the annular member 25. The upper edge of the groove 33 forms an overflow outlet 34 therefrom.

From the radially innermost part of each channel 30 a draining channel 35 extends through the rotor part 11 to the outside of the rotor. A shielding member 36 is connected with the drive shaft 2 and arranged to prevent liquid leaving the rotor through the draining channels 35 from flowing down into the housing 4 of the driving device. The rotor housing 5 has a separate outlet 37 for such liquid.

Figure 2:
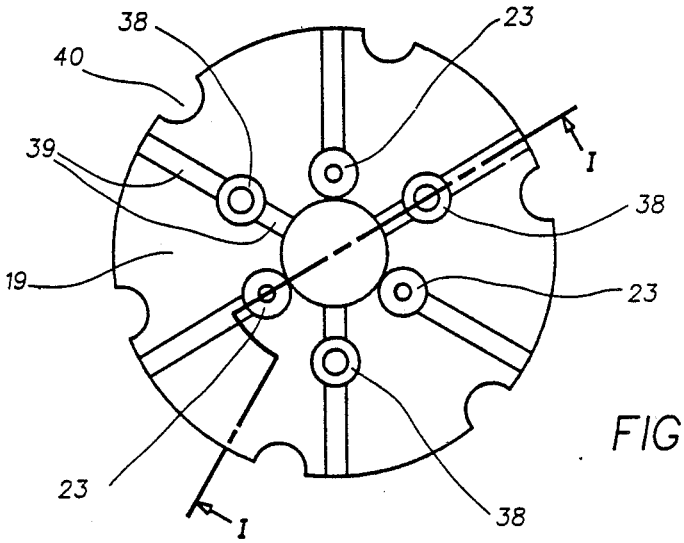
FIG. 2 shows a detail of a part of the centrifugal separator according to FIG. 1 seen from above.

FIG. 2 shows from above the partition member which comprises the conical part 19. Apart from the previously mentioned three tubular members 23 another three tubular members 38 are shown, through the openings of which the tubes 32 (FIG. 1) are intended to be inserted. As seen most evidently from FIG. 2, the tubular members 38 are situated at a larger radius than the tubular members 23.

Radially and axially extending ridges 39 on the upper side of the conical part 19 form between themselves the previously mentioned recesses, forming, together with the rotor part 12, the passages 20 in FIG. 1.

Around its periphery the conical part 19 has a number of recesses 40, the function of which will be described later. Corresponding recesses axially aligned with the recesses 40 are present in all of the separating discs 21 in the separation chamber 13.

Figure 3:
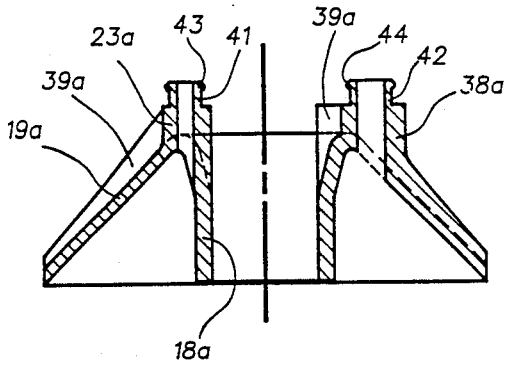
FIG. 3 shows an axial section of a somewhat modified detail according to FIGS. 1 and 2.

FIG. 3 shows a section through a somewhat modified partition member comprising a conical part 19*a*, a sleeve formed part 18a and tubular members 23*a* and 38*a*. The partition member shown in FIG. 3 is intended to be made entirely of plastic and, as can be seen, the tubular members 23*a* and 38*a* have been formed in a way to establish a firm connection between these and the rotor part 12. Sleeve-formed extensions 41 and 42 having small external annular end flanges 43 and 44, respectively, are dimensioned such that they are resilient when inserted into holes in the rotor part 12 intended therefor.

Figure 4:
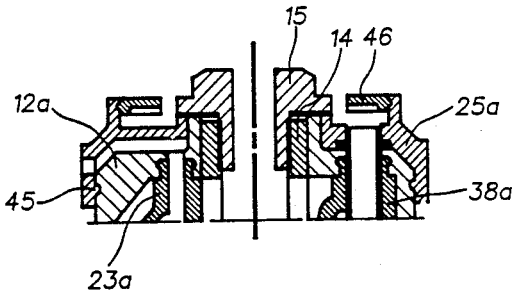
FIG. 4 shows a modified embodiment of part of the centrifugal separator of FIG. 1.

FIG. 4 shows the upper part of a rotor according to FIG. 1 comprising a partition member according to FIG. 3. The tubular members 23*a* and 38*a* are inserted into through channels in the rotor part 12*a*. The walls of these channels have annular grooves for receiving the annular end flanges 43 and 44 (FIG. 3). The partition member thus is connected with the rotor part 12*a* by means of a so called snap-lock connection.

A further so called snap-lock connection is present between the rotor part 12*a* and the annular member 25*a*. The latter has an internal annular flange 45 engaging an external groove in the rotor part 12*a*.

Instead of a fixed end wall the annular member 25*a* has a removable and, thus, exchangeable annular end wall 46, the inner edge of which forms an overflow outlet corresponding to the overflow outlet 34 in FIG. 1. Also the end wall 46 is kept in place at the annular member 25*a* by means of a so called snap-lock connection.

The centrifugal separator in FIG. 1 is intended to operate in the following manner after the rotor 1 has been put in rotation by means of the driving device 3.

Through the pipe 6 a mixture of two liquids with different densities and solid particles suspended therein is supplied into the central inlet chamber 16. The mixture flows further through the openings 17 and the passages 20 to the separation chamber 13. Mainly through the recesses 40 in the conical part 19 and the corresponding recesses in the separation discs 21 the mixture is distributed between the separation discs.

In the passages 20 a pre-separation of the three components of the supplied mixture already takes place. A large part of the suspended solids and part of the heavier of the liquids move along the rotor part 12 out to the surrounding wall of the separation chamber 13 without disturbing the further flow of the liquid mixture into the separation chamber. The liquid mixture with, possibly remaining solids, is then distributed between the separation discs 21. Between the separation discs the two liquids of different densities are separated, the lightest liquid flowing radially inwards and being conducted through the channels 22 and 24 to the chamber 26, and the heaviest liquid flowing radially outwards. Outside the separation discs 21 the latter liquid flows axially downwards in the separation chamber and out thereof through the channels 29. It is conducted further through the channels 30 and 31 and by the tube 32 to the annular groove 33.

While the separated heavy liquid is discharged over the overflow outlet 34, the separated light liquid leaves through the outlet 27 of the chamber 26. The outlet 27 is so large that the chamber 26 during normal operation is only partly filled. This means that the tubular members 23 and the radially outer walls of the channels 22 and 24 form overflow outlets from the separation chamber 13 for the separated light liquid. The position of the interface layer between the two separate liquids formed in the separation chamber during operation is determined by the positions of the two overflow outlets from the separation chamber. The position of the interface layer may be changed by exchange of the annular member 25 for another one, the overflow outlet 34 of which is situated at a different radial level. Of course, alternatively, an exchangeable, so-called gravity disc may be arranged in either the chamber 26 or the groove 33.

If desired, conventional distribution channels extending axially through the separation discs 21 and the conical part 19 may be located at any desired distance from the rotor axis.

Upon need the annular member 28 at the bottom of the separation chamber may be exchanged for another one having a larger or smaller radial extension.

For the removal of separated solids from the separation chamber the locking member 15 has to be removed and the rotor parts 11 and 12 have to be separated.

Since during operation the channels 22 and 24 will serve as overflow outlets from the separation chamber 13, a free liquid surface will be formed in the separation chamber radially outside the sleeve formed part 18, around the central column 14. Possible leakage past the gasket between the column 14 and the sleeve formed part 18 therefore will be directed from the inlet chamber 16 to the separation chamber 13. Since the lower portion of the sleeve formed part 18 is situated at a substantial axial distance from the overflow outlet 24 for separated light liquid, possible such leakage of a smaller magnitude will not influence the separation in the rotor.

In a preferred embodiment of the invention the details 11, 12 and 32 are made of metal, whereas the details 18, 19, 25 and 28 are made of plastic. Instead of separate sealing members, such as gaskets, placed between the tubular members 23, 38 and the rotor part 12, thereby, the tubular members 23 and 38 made of plastic may themselves accomplish sealing. Preferably this is achieved by forming the members in question such that a firm connection, e.g. a so called snap-lock connection, is obtained between these and the rotor part 12 (FIG. 4). This avoids that need to break up the important sealing between the tubular members 23, 38 and the rotor part 12 every time the rotor is disassembled; in other words the sealing function will be safer and will not be jeopardized by wear or damage. In addition, disassembling and mounting of the rotor are simplified by the fact that the rotor will consist of a smaller number of parts. Even the uppermost annular member 25 may be formed so that a firm connection can be obtained between this and the rotor part 12 (FIG. 4).

The tubes 32 preferably are fixed in the rotor part 11, so that they can maintain the separation discs 21 in unchanged positions when the rotor part 12 is removed. The tubes 32 thus serve as guiding means for the separation discs 21 and prevent these from being turned relative to each other during rotation of the rotor.

I claim:

1. A centrifugal separator for the separation of two components from a liquid mixture comprising a rotor body having a central inlet chamber and a separation chamber, said separation chamber having two ends, an inlet for the liquid mixture to be separated, and at least one outlet for a separated component of said mixture, a plurality of conical separation discs positioned in said separation chamber coaxially with said rotor, each of said discs having an apex portion and a base portion, the base portions of said discs facing one end of the separation chamber and the apex portions facing the other end, a partition member arranged between the separation discs and the rotor body, said partition member forming, with a part of the rotor body, inlet passages connecting said central inlet chamber with said separation chamber at the end of the separation chamber towards which the apex portions of the separation discs face, a plurality of holes in said partition member and corresponding holes in the body of said rotor, and a plurality of tubular members sealingly connected to the partition member and the rotor body around said holes, said tubular members forming closed outlet channels from the separation chamber, said channel extending in a direction transverse to the inlet passages extending between the inlet chamber and the separation chamber.

2. The centrifugal separator claimed in claim 1 wherein the tubular members are formed in one piece with one of the rotor body and the partition member.

3. The centrifugal separator claimed in claims 1 or 2 wherein the tubular members are firmly connected with both the partition member and said part of the rotor body for keeping them together when the rotor body is disassembled.

4. The centrifugal separator claimed in claims 1 or 2 wherein the rotor body comprises a first rotor part having a central column and a second rotor part removably connected with the column and connected with said partition member by means of the tubular members, and wherein the partition member comprises a central sleeve sealingly surrounding the central column and axially movable relative thereto.

5. The centrifugal separator claimed in claim 4 wherein the separation discs have a frustro-conical form and the central sleeve extends axially past several separation discs.

6. The centrifugal separator claimed in claims 1 or 2 wherein the partition member comprises a conical part whose cone angle substantially corresponds to that of the separation discs.

7. The centrifugal separator claimed in claim 6 wherein the conical part of the partition member has substantially the same radial extension as the separation discs.

8. The centrifugal separator claimed in claims 1 or 2 and comprising separate guiding members for the separation discs; ends of said guiding members being connected with the rotor body, there being axially aligned recesses in said separation discs, and said guiding members, at their mid-sections, extending through said axially aligned recesses.

9. The centrifugal separator claimed in claim 8 wherein said guiding members form channels which at the end of the separation chamber toward which the base portions of the separation discs face, communicate with an outlet from the separation chamber for separated heavy liquid component of the liquid feed mixture and at the opposite end of the separation chamber communicate with an outlet from the rotor for the heavy liquid component.

10. The centrifugal separator claimed in claim 9 wherein the channels in the guiding members communicate with some of said through holes in the partition member and said part of the rotor body respectively, the remainder of said holes thus forming outlets for a separated relatively light liquid component of the supplied liquid mixture.

* * * * *